United States Patent [19]

Tasma

[11] Patent Number: 4,824,144

[45] Date of Patent: Apr. 25, 1989

[54] COLOR IDENTIFICATION SYSTEM

[76] Inventor: Gerald W. Tasma, 12600 Shaner, N. E., Cedar Springs, Mich. 49319

[21] Appl. No.: 37,163

[22] Filed: Apr. 10, 1987

[51] Int. Cl.[4] ..... B42D 15/00

[52] U.S. Cl. ..... 283/87; 283/74; 283/99; 283/114

[58] Field of Search ..... 283/74, 85, 87, 99, 283/100, 114

[56] References Cited

U.S. PATENT DOCUMENTS

| | | | |
|---|---|---|---|
| 1,032,024 | 7/1912 | Rawlings | 283/99 X |
| 1,218,082 | 3/1917 | Hall | 35/2 |
| 1,285,753 | 11/1918 | Lowenstein | 283/114 X |
| 1,422,527 | 7/1922 | Berger | 35/2 |
| 2,417,163 | 3/1947 | Horst | 35/2 |
| 3,248,050 | 4/1966 | Dickson | 235/89 |
| 3,251,141 | 5/1966 | McRae | 283/85 X |
| 3,287,825 | 11/1966 | Ryan et al. | 35/2 |
| 3,969,830 | 7/1976 | Grasham | 35/2 |
| 4,175,775 | 11/1979 | Kruegle | 283/7 |
| 4,512,581 | 4/1985 | Levine | 283/100 X |

FOREIGN PATENT DOCUMENTS

| | | | |
|---|---|---|---|
| 1512018 | 5/1978 | United Kingdom | 283/85 |

*Primary Examiner*—Paul A. Bell

*Attorney, Agent, or Firm*—Varnum, Riddering, Schmidt & Howlett

[57] ABSTRACT

This relates to an identification system for authenticating labels and cards. Each label or card would be provided with authenticating characters which are printed in color and which are at least in part in overlapping relation so as to make it difficult to identify the individual characters by eye. However, when a pair of overlapping characters is viewed through a colored filter, depending upon the color of the filter, one or other of the two superimposed characters would appear. By providing the authenticating characters in a preselected arrangement and utilizing colored filter segments in a similar preselected arrangement, only those authenticating characters which form part of the authenticating information would appear.

17 Claims, 1 Drawing Sheet

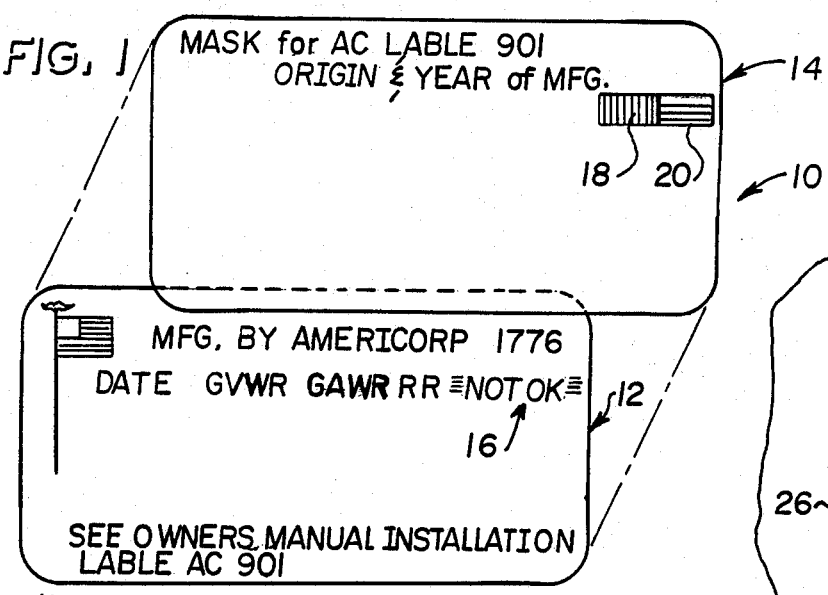
FIG. 1
FIG. 2
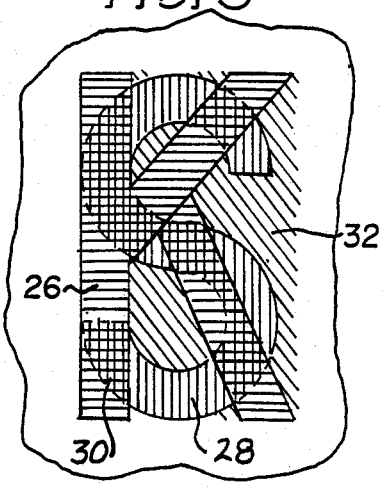
FIG. 3
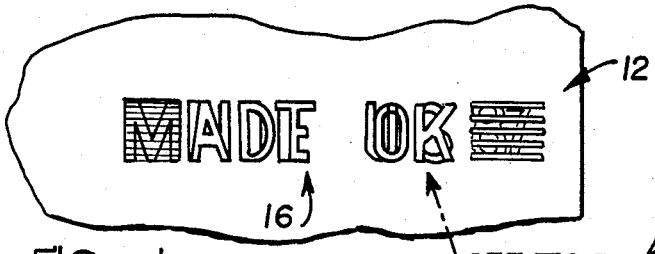
FIG. 4
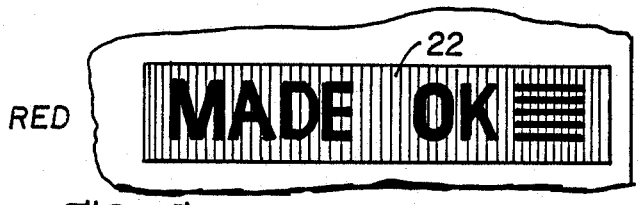
FIG. 5
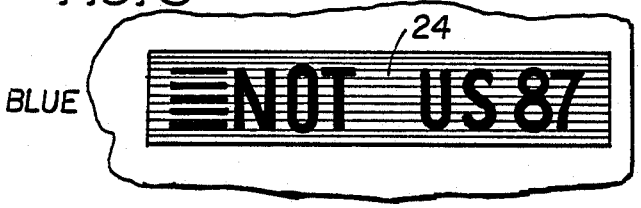
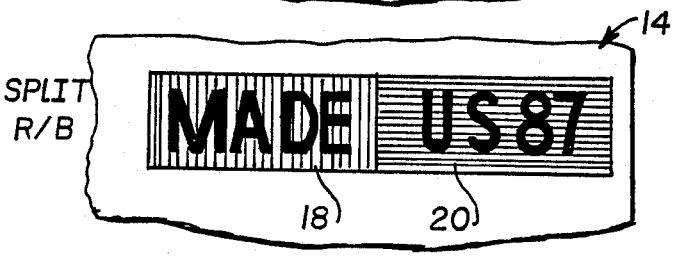
FIG. 6
FIG. 7
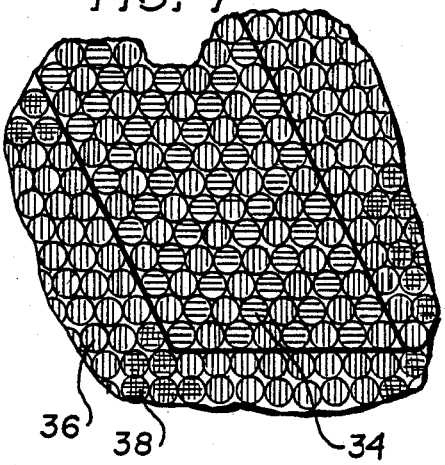
FIG. 8
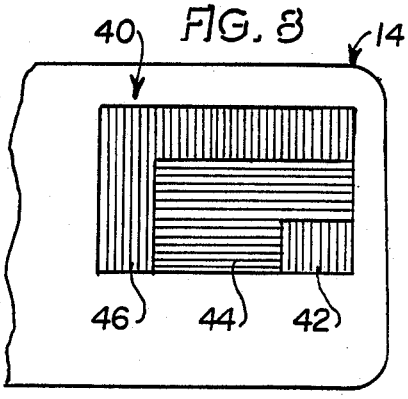

COLOR IDENTIFICATION SYSTEM

This invention relates in general to new and useful improvements in identification systems, and more particularly to a color identification system wherein an identifying member is provided with characters of different colors in overlapping relation with certain of the characters of different colors forming authentication characters, and the colored characters being viewable through a filter arrangement whereby an authentic identification member will have the authentication characters thereof appear in the filter system for authenticating purposes.

BACKGROUND

In the past it has been known to print images in different colors and when these images are either viewed through filters or certain correlated colors or projected utilizing lights of different colors or filters of different colors, the images will change depending upon the colors involved. It is also known to print characters of different colors in overlapping relation such that the overlapped characters, when viewed through one colored filter will result in the appearance of one of the characters and when viewed through a second and different colored filter, will reveal the other of the superimposed characters. It is also known to form photo I.D. cards wherein different colors are involved and the I.D. card is a laminate of a construction which will prevent tampering.

The afore-broadly identified prior art is the subject of prior U.S. patents. These patents include Rawlings 1,032,024 patented July 9, 1912; Hall 1,218,082 patented Mar. 6, 1917; Berger 1,422,527 patented July 11, 1922; Horst 2,417,163 patented Mar. 11, 1947; Dickson 3,248,050 patented Apr. 26, 1966; Grasham 3,969,830 patented July 20, 1976; Kruegle 4,175,775 patented Nov. 27, 1979; and Levin 4,512,581 patented Apr. 23, 1985.

SUMMARY OF THE INVENTION

The invention relates to identification systems such as a label, credit card, lottery ticket or similar type of matter wherein information is conveyed from a card or label. In accordance with the invention, a number, a letter or a series of numbers or letters are printed on the identifying member and the identifying member is then read by an inspector or a merchant, for example, in the case of a credit card.

The invention contemplates the use of printing system wherein at least two colors are used to define the identification characters such as numbers, letters, symbols or words. The colors are preferably printed in small dots with each color defining a character or a portion of a character. However, each of these characters is overprinted with a second color, also with a series of dots forming complete characters or portions of characters. The result is that the message or identification number or words are not readable with the ordinary eye. According to the invention, a complex two or more color filter system is used in a predetermined relationship to the identifying member so that the message or identification symbol can be easily read.

The invention contemplates that the identifying member has characters in at least two different colors wherein certain of the characters of at least two of the colors form an authentication mark which is in a preselected pattern of at least two portions, one portion of which is in one color and another portion of which is in a second color. The filter system which may be termed an "authenticating device" includes filter segments with each filter segment being of a different color and being a filter for at least one of the two colors of the identifying member. The filter segments are arranged in a preselected pattern. The identifying member and the authenticating device have a preselected relationship with each other so that only the authentication mark will appear when the identifying member is associated with the authenticating device in the preselected relationship.

With the above and other objects in view that will hereinafter appear, the nature of the invention will be more clearly understood by reference to the following detailed description, the appended claims, and the several views illustrated in the accompanying drawings.

SHORT DESCRIPTION OF FIGURES

FIG. 1 is a perspective view showing a typical identifying member and an authenticating device associated therewith.

FIG. 2 is an enlargement of that portion of the identifying member having authenticating printing thereon in accordance with this invention.

FIG. 3 is an enlarged plan view of one pair of overprinted numbers in accordance with the invention.

FIG. 4 is a plan view of the printed characters of FIG. 2 as viewed through a colored filter corresponding to one color of the printed characters.

FIG. 5 is a plan view similar to FIG. 4 but wherein a different colored filter is utilized.

FIG. 6 is another plan view similar to FIG. 4 but wherein, specifically in accordance with the invention, the colored characters of FIG. 2 are viewed through a special filter in accordance with the invention formed of filter segments of different colors.

FIG. 7 is an enlarged fragmentary plan view showing a portion only of the overprinted characters of FIG. 3 wherein the characters are formed by small dots of different colors.

FIG. 8 is a fragmentary plan view of yet another authenticating device wherein the filter segments vary in shape and arrangement.

DESCRIPTION OF THE INVENTION

Referring now to FIG. 1, it will be seen that there is illustrated an identification system, which is generally identified by the numeral 10, and which includes an identifying member, generally identified by the numeral 12, and an authenticating device, generally identified by the numeral 14. The illustrated identifying member 12 is in the form of a label which may be applied to a piece of equipment. However, it is to be understood that the identifying member 12 may, in a like manner, be in the form of a credit card, a lottery ticket or similar type of matter wherein information is conveyed from a card or label. In accordance with this invention, the identifying member 12 not only will be provided with the customary identifying indicia, but also authenticating indicia a mark identified by the reference number 16. The authenticating indicia 16 is in the form of a plurality of characters printed in different colors and in overlapping relation as will be described in more detail hereinafter.

The authenticating device 14 is illustrated as a simple mask which may be placed in overlying relation with respect to the label 12 in a preselected relationship and includes filter segments 18, 20 which open through the authenticating device 14 and are placed on the authenticating device 14 in alignment with the authenticating indicia 16.

Reference is now made to FIG. 2 wherein the authenticating indicia 16 is illustrated on a much larger scale. Preferably the authenticating indicia 16 is printed in two colors at a minimum and may consist of three or more colors. Further, normally each character of the authenticating indicia 16 will be of an overlay type involving two characters. With respect to this overlay type, reference is made to FIG. 3 wherein it will be seen that the letters K and S are printed in overlying relation. The letter K is printed in blue while the letter S is printed in red in the illustrated example.

Referring now to FIG. 4, it will be seen that when the authenticating indicia 16 is viewed through a red filter 22, all of the printed characters when are red are blocked out and only those characters which are printed in blue will be seen. Thus the authenticating indicia 16 of FIG. 2 will appear in FIG. 4 as "MADE OK." On the other hand, with reference to FIG. 5, it will be seen that when the authenticating indicia 16 is viewed through a blue filter 24, all of the characters which are printed in blue will not be seen and thus the authenticating indicia 16 will appear as "NOT US 87".

While each of the readings of the authenticating indicia 16 in FIGS. 4 and 5 make sense, this is not the authenticating code that is to be detected utilizing the authenticating device 14.

On the other hand, when the authenticating device 14 is aligned in the preselected relationship with the label 12, the left-hand segment 18, i.e. the red filter segment, overlies the left portion of the authenticating indicia 16 so that the word "MADE" will appear. At the same time, the right-hand segment 20, i.e. the blue filter segment, overlies the right part of the authenticating indicia 16 so that there appears "US 87". Thus what is seen through the authenticating device 10 is the authenticating indicia "MADE US 87".

The foregoing is a typical simple example of the utilization of the invention.

Referring once again to FIG. 3, it is to be noted that three colors may be utilized in the printing of the authenticating characters. There will be blue areas identified by the numeral 26, red printing identified by the numeral 28 and a mixture of red and blue printing 30. Further, the general block in which the authenticating characters "S" and "K" appear may otherwise include a third printed color arrangement identified by the numeral 32. This color arrangement may, for example, be yellow.

At this time it is also pointed out that when a two color system is utilized, it is not necessary that the colors be red and blue as discussed in the example. One could have, for example, a combination of blue and yellow or a combination or red and yellow. In addition, it is feasible to utilize even more colors depending upon the nature of the authenticating characters.

Reference is now made to FIG. 7 wherein the manner of forming the various colored areas shown in FIG. 3 is illustrated. The printing may be in the form of small dots and with respect to the example in FIG. 3, there would be a multiple color printing with selected dots being of selected colors. For example, dots 34 will be blue in color while dots 36 are red in color. Further, dots 38 may, for example, be yellow in color.

It is to be understood that the overall printing will be a series of dots and in areas where there is overprinting, the color of the dots will be alternating whereas in other areas, the dot colors will be all the same. If desired, as illustrated in FIG. 7, all of the possible dots will have a color. On the other hand, it is feasible that instead of all of the dots 34 in the blue area being blue, only every other dot would be blue while the area of the other dots would be left uncolored. A determination as to whether there would be uncolored areas would depend on whether or not, for example, a deep blue or a light blue is desired.

Although in the example shown in FIGS. 1–7 the authenticating characters are in a single line, it is to be understood that this is merely an example of the simplest possible arrangement. If desired, the authenticating characters may be printed in several lines or be arranged in a more complex pattern. In such event, the filter segments 18, 20 may either be much deeper to take care of several lines of authenticating characters, or there may be a more complex filter segment arrangement such as that shown in FIG. 8. In the illustrated embodiment of a modified form of filter which would provide for authenticating three lines of characters with the possibility that there may be a varied color arrangement in each line, there is provided a filter arrangement generally identified by the numeral 40. The filter arrangement 40 includes a red filter segment 42 down in the bottom right-hand corner. Next there would be a generally rectangular blue filter segment 44 having a lower right-hand corner notch in which there is inserted the blue segment filter 42. Finally, there would be the filter segment 46 which is red and which is generally angular in outline and extends across the top and the left side of the filter segment 44.

While the filter arrangement 40 is of a two color effect, it is to be understood that three colored filters may be involved.

Finally, it is pointed out here that although the only illustrated authenticating device is in the form of a mask-like device 14, the filter system could be contained in a machine which is typically in the possession of an authorized person such as a police officer or a merchant. The filter system preferably would have a fixed position with respect to a guide for the card which is being authenticated.

The specific nature of the authenticating indicia may be varied depending upon the usage. For example, when the system is utilized for a credit card, the multiple colored printing may be utilized for identification of the card number. In addition, personal information as to the bearer of the card could also be printed with the system. Thus when the card is read by the merchant, it could give the merchant not only the identification number, but personal data relating to the bearer. Thus, if the credit card was stolen or counterfeited, the merchant could immediately tell from the personal data that the card does not match the bearer.

Although only a preferred form of the identification system has been specifically illustrated and described herein, it is to be understood that minor variations may be made in the identification system without departing from the spirit and scope of the invention as defined by the appended claims.

I claim:

1. An identification system comprising an identifying member and an authenticating device, said identifying member having thereon characters in at least two different colors with areas of said characters overlapping so as to be confusing to the naked eye, certain of said characters of at least two of said colors being an authentication mark, said authentication mark being in a preselected pattern of at least two portions, one portion in one color and another portion in a second color, and said authenticating device including filter segments with each filter segment being of a different color and being a filter for at least said two colors, and said filter segments being arranged in said preselected pattern, said identifying member and said authenticating device having a preselected relationship with each other whereby said authentication mark will appear only when said identifying member is associated with said authenticating device in said preselected relationship.

2. An identification system according to claim 1 wherein said characters when viewed through a single color filter of one of said colors will provide a viewable arrangement of characters other than said preselected pattern.

3. An identification system according to claim 1 wherein said characters when viewed through a single color filter of either of said colors will provide a viewable arrangement of characters other than said preselected pattern.

4. An identification system according to claim 1 wherein said characters are printed in the form of a plurality of individual dots of different colors.

5. An identification system according to claim 1 wherein said characters are printed in the form of a plurality of individual dots of different colors, and said dots are intermingled in areas where said characters overlap.

6. An identification system according to claim 1 wherein there are at least three different colors.

7. An identification system according to claim 1 wherein said filter segments are in alignment with one another.

8. An identification system according to claim 1 wherein said filter segments are disposed in angular relation.

9. An identification system according to claim 1 wherein said filter segments are disposed for authentication of characters arranged in plural lines.

10. An identification system according to claim 1 wherein said filter segments are at least three in number.

11. An identification system according to claim 1 wherein said filter segments are at least three in number and of only two colors.

12. An identifying member for use as part of an identification system, said identifying member having thereon characters in at least two different colors with areas of said characters overlapping so as to be confusing to the naked eye, certain of said characters of at least two of said colors being an authentication mark, said authentication mark being in a preselected pattern of at least two portions, one portion in one color and another portion in a second color, said identifying member being adapted for use in an identification system including an authenticating device, said authenticating device including filter segments with each filter segment being of a different color and being a filter for at least said two colors, and the filter segments being arranged in said preselected pattern, said identifying member and the authenticating device having a preselected relationship with each other whereby said authentication mark will appear only when said identifying member is associated with the authenticating device in said preselected relationship.

13. An identifying member according to claim 12 wherein said characters when viewed through a single color filter of one of said colors will provide a viewable arrangement of characters other than said preselected pattern.

14. An identifying member according to claim 12 wherein said characters are printed in the form of a plurality of individual dots of different colors.

15. An identifying member according to claim 12 wherein said characters are printed in the form of a plurality of individual dots of different colors, and said dots are intermingled in areas where said characters overlap.

16. An identifying member according to claim 12 wherein there are at least three different colors.

17. An authenticating device for use in an identification system, said authenticating device including at least three filter segments with each filter segment being of a different color and being a filter for at least two preselected colors, and said filter segments being arranged in a preselected pattern in plural lines for alignment with colored characters arranged in said preselected pattern, said authenticating device being adapted for use in an identification system of the type where an identifying member has thereon characters in at least three different colors with areas of said characters overlapping so as to be confusing to the naked eye, certain of the characters of at least three of the colors being an authentication mark, said authentication mark being in a preselected pattern of at least three portions, one portion in one color, another portion being in a second color and a third portion being in a third color, the authenticating device and the identifying member having a preselected relationship with each other whereby the authentication mark will appear only when the identifying member is associated with the authenticating device in the preselected relationship.

* * * * *